US007123218B2

(12) United States Patent
Takayama et al.

(10) Patent No.: US 7,123,218 B2
(45) Date of Patent: Oct. 17, 2006

(54) METHOD FOR DRIVING PLASMA DISPLAY PANEL

(75) Inventors: Kunio Takayama, Kawasaki (JP); Kenji Awamoto, Kawasaki (JP); Yasunobu Hashimoto, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 345 days.

(21) Appl. No.: 10/459,608

(22) Filed: Jun. 12, 2003

(65) Prior Publication Data

US 2004/0001036 A1 Jan. 1, 2004

(30) Foreign Application Priority Data

Jun. 26, 2002 (JP) ..... 2002-186054

(51) Int. Cl.
*G09G 3/28* (2006.01)

(52) U.S. Cl. ..... 345/62; 345/66

(58) Field of Classification Search ..... 345/62, 345/66, 63, 690

See application file for complete search history.

(56) References Cited

U.S. PATENT DOCUMENTS 6,198,476 B1 * 3/2001 Hong et al. ..... 345/204
6,407,510 B1 * 6/2002 Yoo et al. ..... 315/169.4
2002/0158821 A1 * 10/2002 Lim ..... 345/60

FOREIGN PATENT DOCUMENTS

JP 2001-051649 2/2001

* cited by examiner

*Primary Examiner*—Amr A. Awad
*Assistant Examiner*—Donna Lui
(74) *Attorney, Agent, or Firm*—Staas & Halsey LLP

(57) ABSTRACT

A method for driving a plasma display panel is provided in which a time necessary for an addressing process is shortened without using any special driving component. The method comprises an addressing process that includes the steps of setting light emission operation of the cells of a display of one screen, starting j-th row selection at a point during (j-1)th row selection, and changing the data electrodes from a control state corresponding to display data of the (j-1)th row to a control state corresponding to display data of the j-th row during a period in which the (j-1)th row selection and the j-th row selection are overlapped with each other.

5 Claims, 13 Drawing Sheets

METHOD FOR DRIVING PLASMA DISPLAY PANEL

BACKGROUND OF THE INVENTION

1. Field of the Invention

The present invention relates to a method for driving a plasma display panel (PDP) and a plasma display device for displaying an image utilizing a plasma display panel. The present invention is useful for increasing an addressing speed.

In a display utilizing an AC type plasma display panel, an addressing process is performed for forming an appropriate quantity of wall charge only in cells to be lighted among cells that are arranged in a matrix, and after that a sustaining process is performed for generating display discharge plural times in accordance with a luminance value utilizing the wall charge. The time necessary for the addressing process is proportional to the number of rows of a display screen (i.e., a resolution in the vertical direction). Therefore, the higher the resolution becomes, the shorter the period becomes that can be assigned to display discharge out of the frame period. In addition, the possible number of frame division for a gradation display becomes small. It is desirable to shorten the time necessary for the addressing process as much as possible when increasing the number of display discharge times for improving luminance or increasing the number of frame division for enhancing gradation property.

2. Description of the Prior Art

In a plasma display panel having an n×m matrix display screen, line-sequential addressing is performed by scan electrodes for selecting a row and data electrodes for selecting a column. In a one-frame display, an address period that is assigned to addressing is divided equally to all scan electrodes. Each of the scan electrodes becomes active by being biased to a predetermined selecting potential only during one row selection period. Usually, an order of selecting a row is an arrangement order, and the scan electrode to be active is switched from one side to the other side of the arrangement. In synchronization with this row selection, display data of all columns of the selected row are outputted from the data electrodes in each row selection period. In other words, in accordance with display data, potential values of all data electrodes are controlled at a time. The display data are usually binary data (1 or 0) that indicate whether a cell is lighted or not, and the potential control of the data electrode is also a binary control of whether address discharge is generated or not. If the address discharge is generated in the cell to be lighted, it is called a write form. If the address discharge is generated in the cell not to be lighted, it is called an erase form.

FIGS. 14A and 14B are timing charts of row selection and data output in the conventional method. In FIGS. 14A and 14B, timings of row selection and data output concerning three rows having arrangement orders of 1–3 are shown. The form shown in FIG. 14A is the most typical form in which the row selection is done by shifting the time completely for each row. In this form, the time necessary for addressing one screen is the product of the row selection period and the number of rows. For example, when the row selection period is three microseconds, the number of rows is 480, and the number of subfields (screens) that constitute one field of an interlace display is eight, the time necessary for the addressing process is 11.52 milliseconds, so most portion of the field period (16.7 milliseconds) is consumed for the addressing process. The form shown in FIG. 14B is disclosed in Japanese unexamined patent publication No. 2001-51649, in which row selection periods overlap each other for high speed addressing. In the plasma display panel, there is a phenomenon that discharge begins when some time passes after a cell voltage exceeds a discharge start voltage (a discharge delay). Therefore, some overlap in the row selection does not make any harm to the addressing process. Also in the addressing process shown in FIG. 14B, data output for each row is performed after harmonizing the row selection and the period similarly to the addressing process shown in FIG. 14A. Namely, in the addressing process shown in FIG. 14B, data outputs for two rows also overlap each other by the time equal to the overlapping time of the row selection.

As explained above, the row selections are overlapped with each other so that the time necessary for the addressing process can be shortened. Concerning the row selection, scan electrodes corresponding to the first and the second rows that overlap each other may be driven by different drivers. Here, the number of electrodes that can be handled by a driver made of an integrated circuit is approximately a few tens. Therefore, a few to a few tens of drivers are used for driving scan electrodes whose number is more than a few hundreds in a plasma display panel. Accordingly, when the scan electrodes of two rows overlapping in the row selection are connected to different drivers, the overlapping in the row selection can be realized by using a driver having the same structure as the case of non-overlap.

However, the conventional driving method, in which the row selection is overlapped as shown in FIG. 14B and the start and the end of data output correspond to the row selection, has a problem that is the necessity of a driving circuit having a complicated structure. Namely, since display data of two different rows are outputted with overlapped in the time scale with each other for one data electrode before the overlap in the row selection, a circuit is necessary that memorizes display data of two rows and calculates the logical OR of these data. A driver for a data electrode that is used in the case where the row selection is not overlapped cannot be used without any change.

SUMMARY OF THE INVENTION

An object of the present invention is to shorten a time necessary for an addressing process without using a special driving component.

According to one aspect of the present invention, concerning the addressing process for setting a light emission operation of cells arranged in n rows and m columns in a display of one screen, a length of the period for outputting display data of one row to data electrodes is set to a value shorter than a length of the period for selecting the row by biasing the scan electrode. Then, the j-th ($2 \leqq j \leqq n$) row selection is started at a point during the (j-1)th row selection, and the data electrodes are changed from a control state corresponding to display data of the (j-1)th row to a control state corresponding to display data of the j-th row during the period in which the (j-1)th row selection and the j-th row selection are overlapped with each other.

The j-th row selection and the (j-1)th row selection are overlapped with each other on the time scale, while the j-th data output and the (j-1)th data output are not overlapped with each other on the time scale. Thus, the addressing process can be speeded up without using a special circuit component for overlapping in driving scan electrodes and data electrodes.

FIGS. 1A–1C are timing charts showing timings of row selection and data output according to the present invention. FIGS. 1A–1C show selection timings of three rows A, B and C having consecutive selection orders and timings of data output. The order of the row selection can be an arrangement order of rows, an arrangement order of every other row, or any other order. Namely, the rows A, B and C are not necessarily in consecutive order.

A length of a row selection period T1 for one row is common to all rows, and a length of a data output period T2 for one row is also common to all rows. However, in contrast to the conventional method, the length of the period T2 is not the same as the length of the period T1. There is a relationship of T2<T1. The period Tyy in FIGS. 1A–1C is an overlapping period between the row selection of each row whose selection order is second or after and the previous row selection. The length of the period Tyy is also common to all rows. As shown in FIG. 1B well, the period Tay is the overlapping period between the row selection of each row whose selection order is second or after and data output of the previous row.

FIG. 1A shows the case where the length of the period Tay is zero, i.e., the case where the switch timing from the (j-1)th data output to the j-th data output is identical to the start timing of the j-th row selection. FIG. 1B shows the case where the length of the period Tay satisfies the relationship 0<Tay<Tyy, i.e., the case where the switch timing from the (j-1)th data output to the j-th data output is performed after the start timing of the j-th row selection and before the end timing of the (j-1)th row selection. FIG. 1C shows the case where the length of the period Tay is identical to the length of the period Tyy, i.e., the case where the switch timing from the (j-1)th data output to the j-th data output is identical to the end timing of the (j-1)th row selection.

FIGS. 2A and 2B are graphs showing relationships between an overlap time and a drive margin. Here, a measurement result of the three-electrode AC type plasma display panel that is a typical color plasma display panel is shown. The vertical axis of the graph is a bias voltage (Vxa) that is applied to a display electrode that constitutes an electrode pair for display discharge with a scan electrode during the address period. The plotted dots represent lower limit values Vxa(min) of the bias voltage for realizing a normal control in which lighting or non-lighting is performed in accordance with display data, while the plotted small circles represent upper limit values Vxa (max) of the bias voltage for realizing a normal control. The distance between the two plotted marks corresponds to a width of a voltage margin. In measurement of these values, the length of the data output period (the period T2) is 1.5 microseconds.

As shown in FIG. 2A, the length of the period Tay was fixed to zero, and the length of the period Tyy was changed from zero nanoseconds to 230 nanoseconds. Then, the margin became wider as the period Tyy became longer. The margin was not enlarged when the period Tyy became more than 230 nanoseconds. Therefore, as shown in FIG. 2B, the length of the period Tyy was fixed to 230 nanoseconds, and the period Tay was increased from zero. Then, in the range of period Tay from zero nanoseconds to 150 nanoseconds, the effect of improving the margin due to the overlap of the row selection was not eliminated.

The width of the drive margin shown in FIGS. 2A and 2B indicates that by carrying out the present invention, addressing process can be speeded up, and stable addressing can be realized with small influence of a variation of power source voltage or a variation of environment temperature.

DESCRIPTION OF THE PREFERRED EMBODIMENTS

Hereinafter, the present invention will be explained more in detail with reference to embodiments and drawings.

Figure 3:
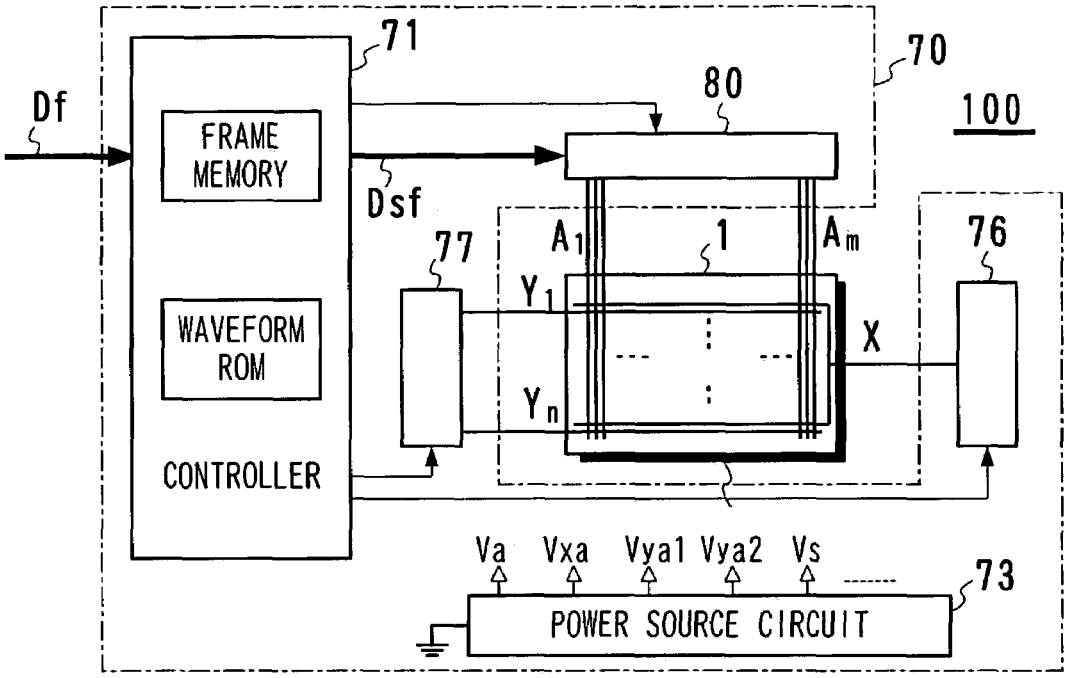
FIG. 3 is a block diagram of a plasma display device according to the present invention.

FIG. 3 is a block diagram of a plasma display device according to the present invention. The display device 100 includes a three-electrode AC type PDP 1 having a display screen made of n rows and m columns and a drive unit 70 for lighting m×n cells selectively, and is used as a wall-hung television set, a monitor of a computer system or others.

In the PDP 1, display electrodes X and Y for generating display discharge that determines light emission quantity of a cell are arranged in parallel so that a pair of the display electrodes X- and Y corresponds to one row. In each cell, a pair of display electrodes X and Y crosses an address electrode A. The display electrodes X and Y extend in the row direction of the display screen (the horizontal direction in FIG. 3), and the display electrode Y among them is used as a scan electrode for selecting a row in the addressing process. The address electrode A extends in the column direction (the vertical direction in FIG. 3) and is used as a data electrode for selecting a column.

The drive unit 70 includes a controller 71, a power source circuit 73, an X-driver 76, a Y-driver 77 and an A-driver 80. The controller 71 includes a frame memory that memorizes image data temporarily and a waveform ROM that memorizes control data of drive voltages. The drive unit 70 is supplied with frame data Df that are multi-valued image data indicating luminance levels of red, green and blue colors from an external device such as a TV tuner or a computer together with various synchronizing signals.

The frame data Df are stored in the frame memory temporarily, then are converted into subframe data Dsf for a gradation display, and are transferred to the A-driver 80 sequentially in the pixel arrangement order. The subframe data Dsf indicates whether the address discharge is necessary or not for each cell of q subframes. The subframe is a binary image with a resolution m×n.

The X-driver 76 changes potential levels of n display electrodes X as a single unit. The Y-driver 77 changes potential levels of n display electrodes Y individually in the addressing process and changes them as a single unit in the sustaining process. The A-driver 80 changes potential levels of m address electrodes (data electrodes) A in accordance with the subframe data Dsf. These drivers are supplied with a power of a predetermined voltage from the power source circuit 73.

Figure 4:
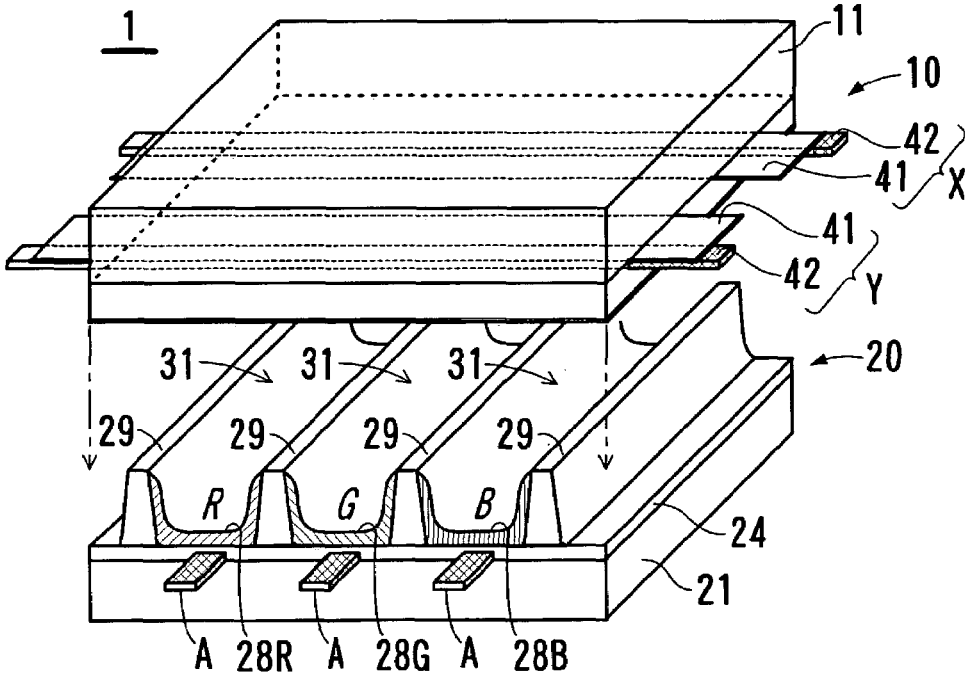
FIG. 4 shows a cell structure of a PDP.

FIG. 4 shows a cell structure of the PDP. In FIG. 4, three cells of the PDP 1 corresponding to one pixel are drawn with a pair of substrate structural bodies that are separated for easy understanding of the inner structure. The PDP 1 includes a pair of substrate structural bodies 10 and 20. The substrate structural body means a structural body including a glass substrate, electrodes and other structural elements disposed on the glass substrate. In the PDP 1, the display electrodes X and Y, a dielectric layer 17 and a protection film 18 are disposed on the inner surface of the front glass substrate 11, while the address electrodes A, an insulator layer 24, partitions 29 and fluorescent material layers 28R, 28G and 28B are disposed on the inner surface of the back glass substrate 21. Each of the display electrodes X and Y includes a transparent conductive film 41 that constitutes a surface discharge gap and a metal film 42 that is a bus conductor. The partitions 29 are disposed so that one partition 29 corresponds to one electrode gap of the address electrode arrangement. These partitions 29 divide a discharge space into columns in the row direction. A column space 31 of the discharge space that corresponds to each column is continuous over all rows. The fluorescent material layers 28R, 28G and 28B are excited locally by ultraviolet rays that are emitted by a discharge gas and emit light. The italic letters R, G and B represent light emission colors of the fluorescent materials.

Hereinafter, drive of the PDP 1 of the plasma display device 100 will be explained. Since the cell of the PDP 1 is a binary light emission element, a halftone is reproduced by setting the number of discharge times of one frame for each cell in accordance with a gradation level. A color display is one kind of a gradation display, so a display color is determined by a combination of luminance levels of three primary colors. A gradation display is realized by dividing one frame into plural subframes having a luminance weight and by setting the number of total discharge times of each cell of one frame as a combination of light or non-light in each subframe. In the case of an interlace display, each of the plural fields constituting the frame is made of plural subfields, and the light control is performed for each subfield. However, the light control itself is similar to the case of a progressive display.

Figure 5:
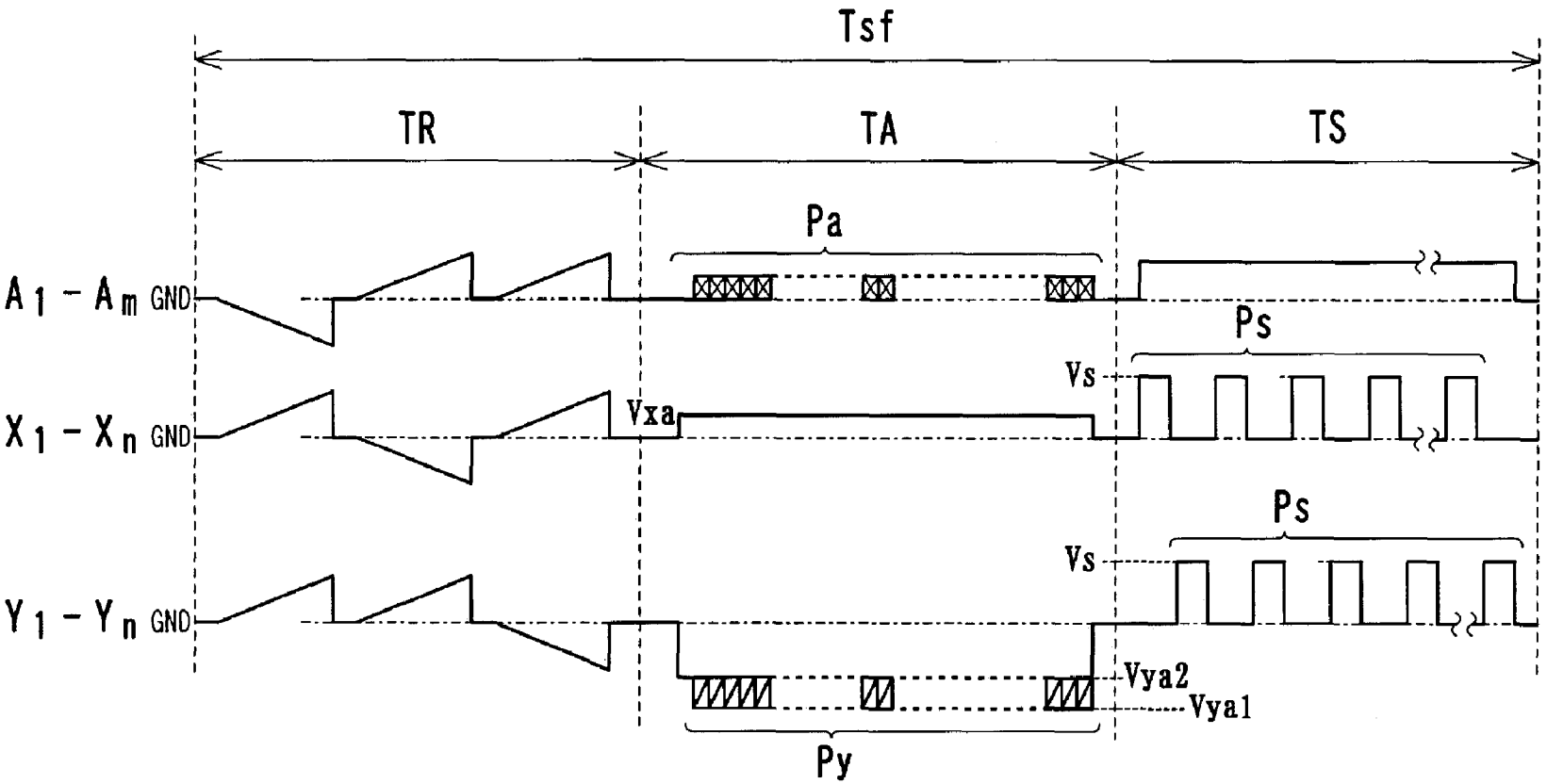
FIG. 5 is a diagram of voltage waveform showing a general driving sequence.

FIG. 5 is a diagram of voltage waveform showing a general driving sequence. In FIG. 5, the suffixes (1-n) of the reference letters of the display electrodes X and Y represent arrangement orders of the corresponding row, while the suffixes (1-m) of the reference letters of the address electrodes A represent arrangement orders of the corresponding column. The waveforms shown in FIG. 5 are merely an example, and amplitude, a polarity and timings can be changed variously.

A subframe period Tsf is assigned to each of the subframes that constitute the frame. The subframe period Tsf includes a reset period TR for initialization that equalize an electrified state of all cells, an address period TA for an addressing process and a display period TS for a sustaining process. The illustrated driving sequence of one subframe is repeated so that a frame is displayed. In contrast that the lengths of the reset period TR and the address period TA are constant regardless of the weight, the length of the display period TS is longer as the luminance weight is larger. Therefore, the length of the subframe period Tsf is longer as the weight of the corresponding subframe SF is larger.

In the reset period TR, a ramp waveform pulse having a predetermined polarity is applied three times to all display electrodes X, all display electrodes Y and all address electrodes A. An application of a pulse means to change temporarily the potential difference between the ground line and an electrode by controlling a bias to each electrode. A changing rate of the voltage of the ramp waveform is set so that micro discharge is generated continuously. The first application of the pulse causes an appropriate wall voltage in all cells in the same polarity regardless of light or non-light in the previous subframe. On this stage, there is some variation among wall voltages of cells. A subsequent application of the pulse makes the wall voltages of all cells equal to a design value in principle.

Figure 1A:
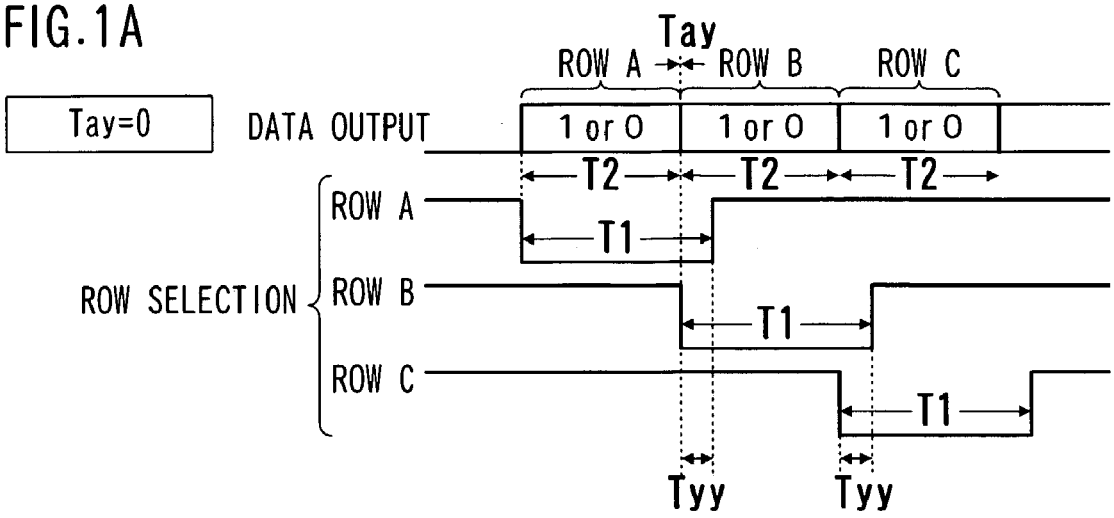
FIGS. 1A–1C are timing charts showing timings of row selection and data output according to the present invention.
Figure 1B:
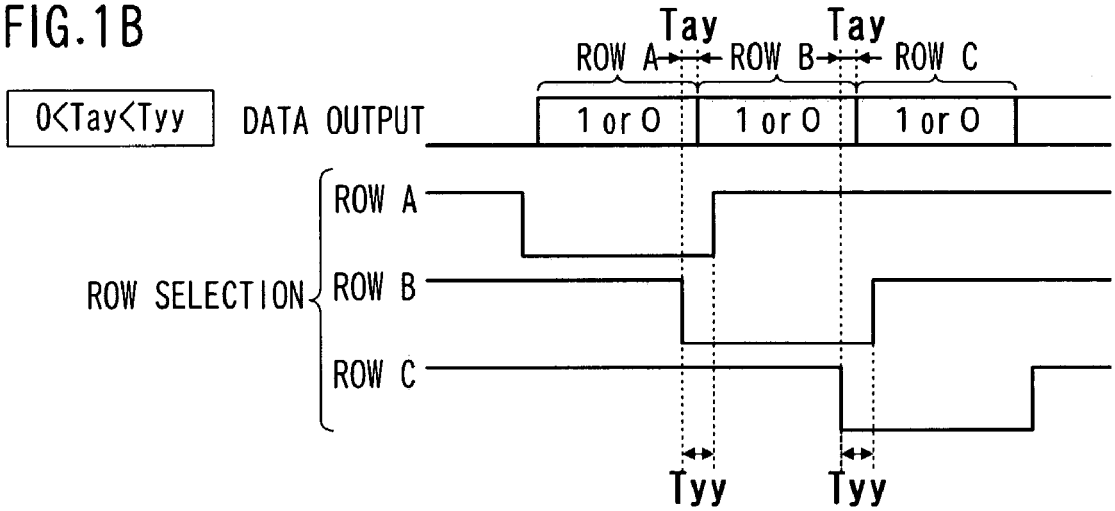
Figure 1C:
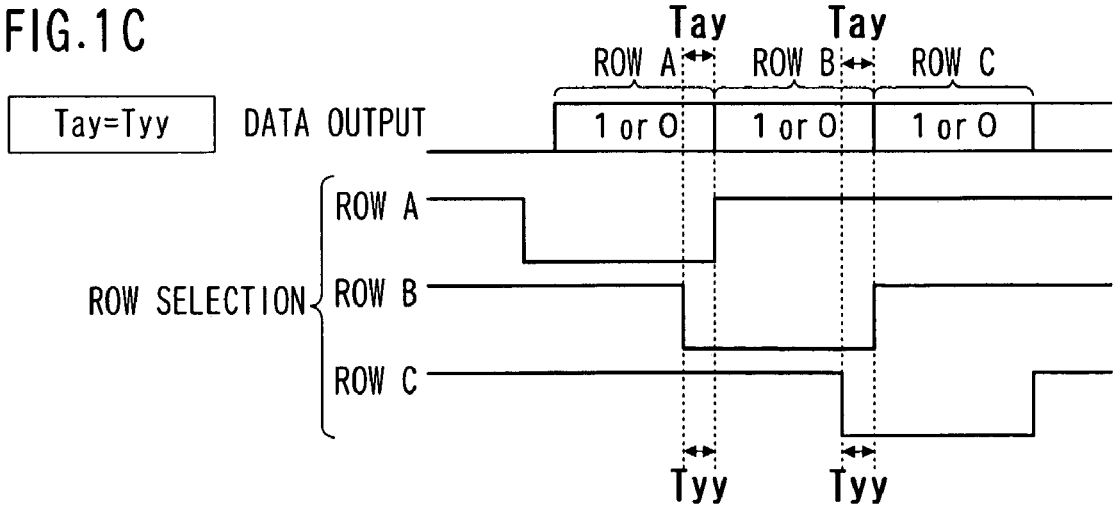
Figure 2A:
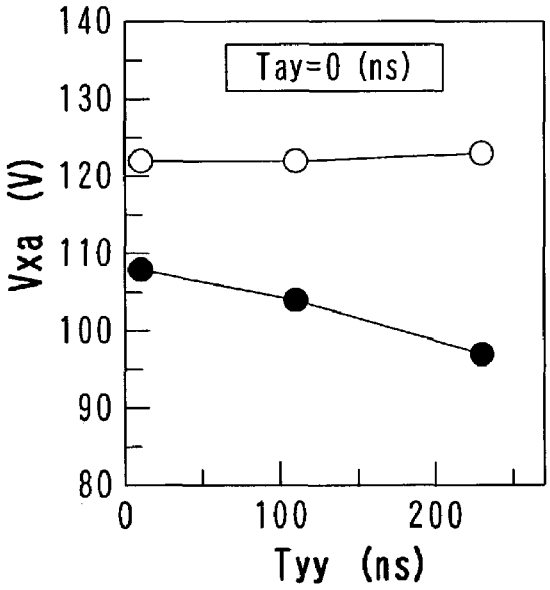
FIGS. 2A and 2B are graphs showing relationships between an overlap time and a drive margin.
Figure 2B:
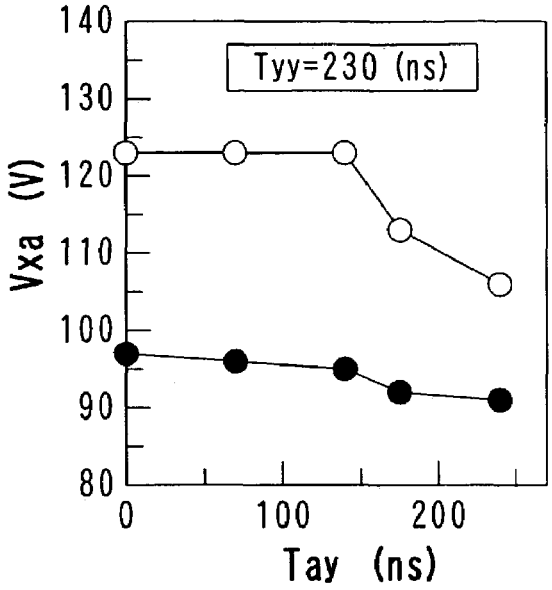

In the address period TA, wall charge that is necessary for the sustaining process is formed only in the cells to be lighted. All of the display electrodes X are biased to the potential Vxa, and all of the display electrodes Y are biased to the potential Vya2. In this state, only the display electrode (scan electrode) Y that corresponds to the selected row is biased to the selecting potential Vya1 temporarily. In other words, the scan pulse Py is applied to a predetermined scan electrode. This row selection is repeated for selecting every row in a predetermined order, which is called a scanning process. On this occasion, as explained with respect to FIGS. 1A, 1B and 1C, the j-th row selection and the (j-1)th row selection are overlapped with each other. In synchronization with the row selection of each row, the address pulse Pa is applied only to the address electrode A that corresponds to the selected cells in which the address discharge is to be generated. Namely, the potential of the address electrode A is controlled in a binary manner in accordance with the subframe data Dsf of m rows in the selected rows. In the selected cell, discharge is generated between the display electrode Y and the address electrode A, and the discharge causes surface discharge between display electrodes. This sequential set of discharge is the address discharge.

In the display period TS, a sustain pulse Ps having amplitude Vs and the positive polarity is applied to the display electrode X and the display electrode Y alternately. Accordingly, a pulse train having alternating polarities is added to the display electrode pair. The application of the sustain pulse Ps causes generation of surface discharge in cells in which predetermined quantity of wall charge is remained. The number of application times of the sustain pulse corresponds to the weight of the subframe as mentioned above. In order to prevent unnecessary discharge, the address electrode A is biased in the same polarity as the sustain pulse Ps during the display period TS.

In the above-mentioned driving sequence, row selection (application of the scan pulse Py) and data output (application of the address pulse Pa) in the address period TA are relevant to the present invention. Hereinafter, structures and operations of the Y-driver 77 and the A-driver 80 related to addressing process will be explained.

Figure 6:
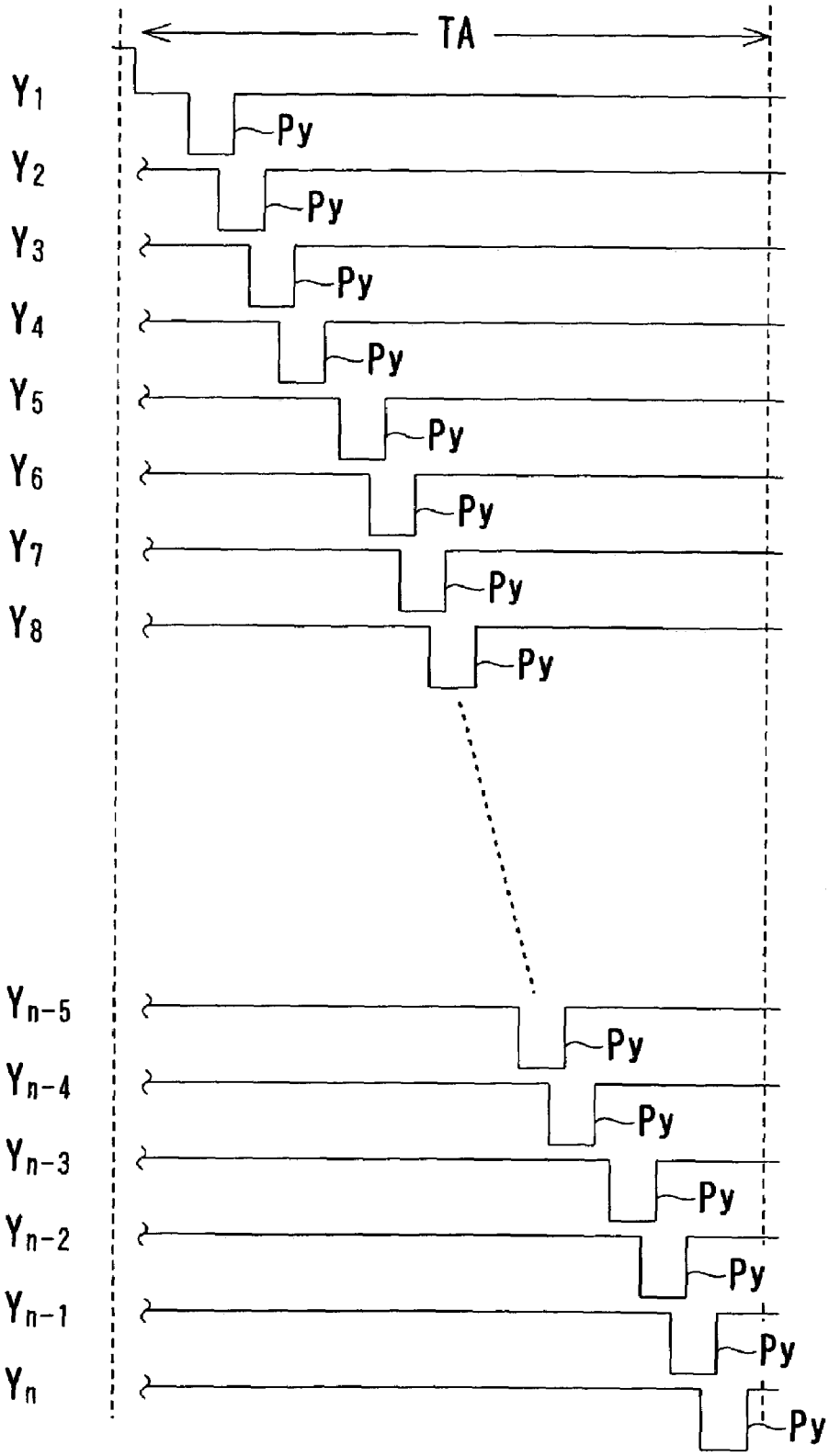
FIG. 6 shows an order of row selection performed by a Y-driver.

FIG. 6 shows an order of row selection performed by a Y-driver. The scan pulse Py is applied to n display electrodes Y in the arrangement order. Namely, the order of the row selection in this example is the arrangement order.

Figure 7:
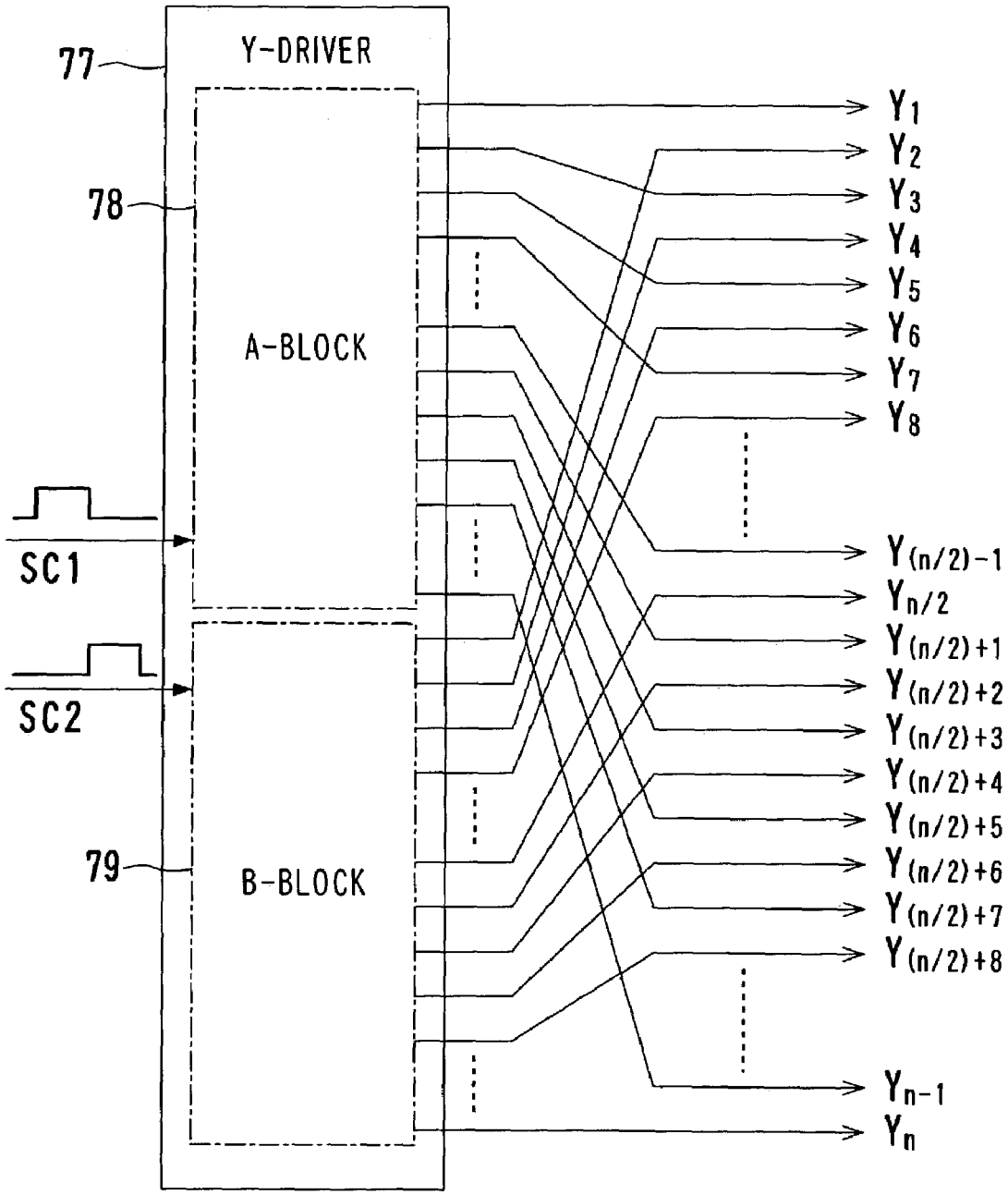
FIG. 7 shows a general structure of the Y-driver and a connection form to display electrodes.

FIG. 7 shows a general structure of the Y-driver and a connection form to display electrodes. The Y-driver 77 includes an A-block 78 that is in charge of odd display electrodes Y and a B-block 79 that is in charge of even display electrodes Y. The circuit structures of these blocks are the same. The A-block 78 performs the scanning process at the period that is twice the period T2 (see FIG. 1) for data output of one row, in accordance with a control signal SC1 from the controller 71 (see FIG. 3). The B-block 79 performs the scanning process at the period that is twice the period T2 in accordance with a control signal SC2. The control signal SC2 corresponds to a delayed signal of the control signal SC1 by a predetermined time. The scanning of the even display electrodes Y by the B-block 79 is started with delay from the commencement of the scanning of the odd display electrodes Y by the A-block 78. This operation realizes the row selection in the order shown in FIG. 6.

Figure 8:
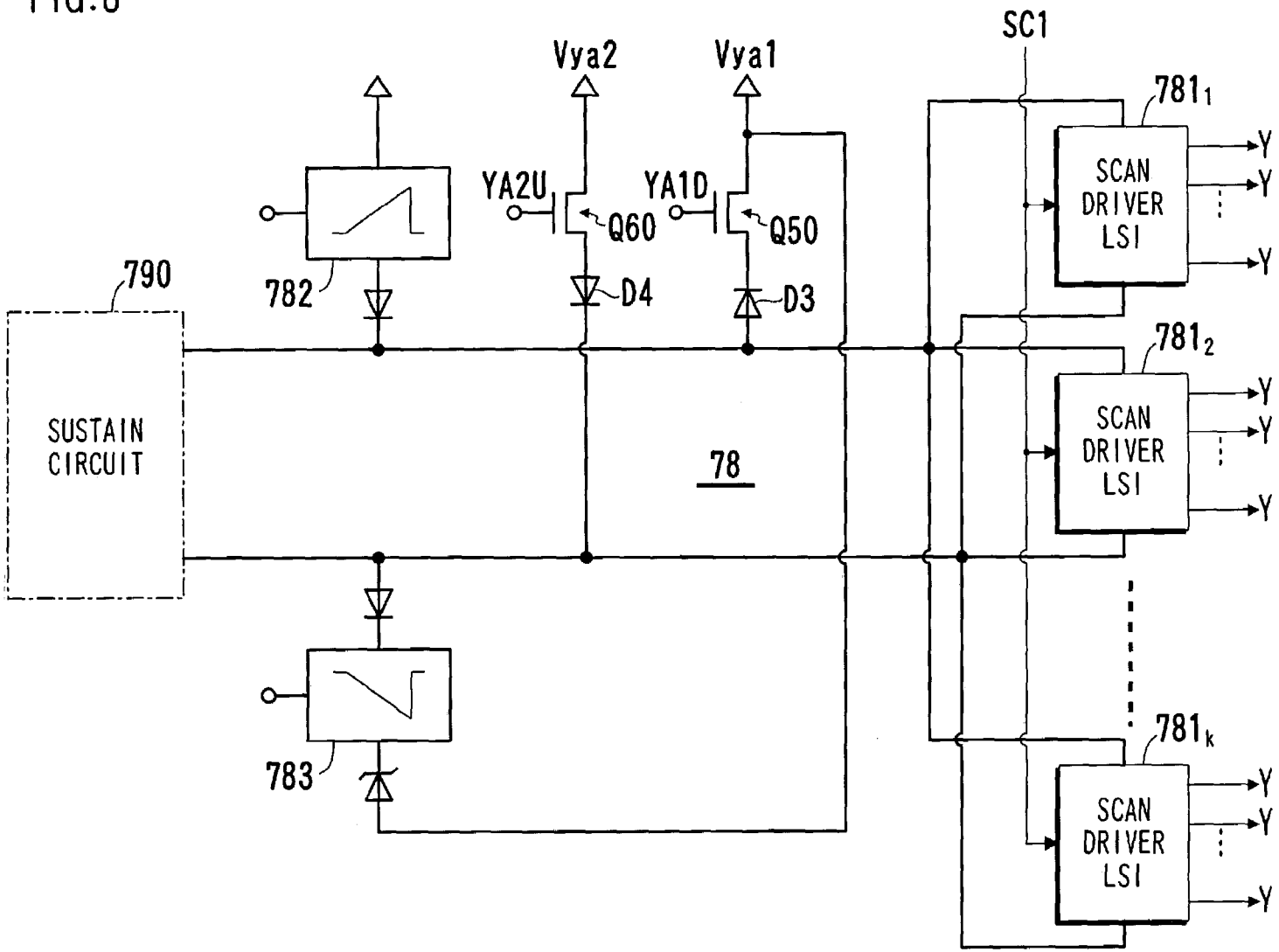
FIG. 8 shows a detail structure of the Y-driver.
Figure 9:
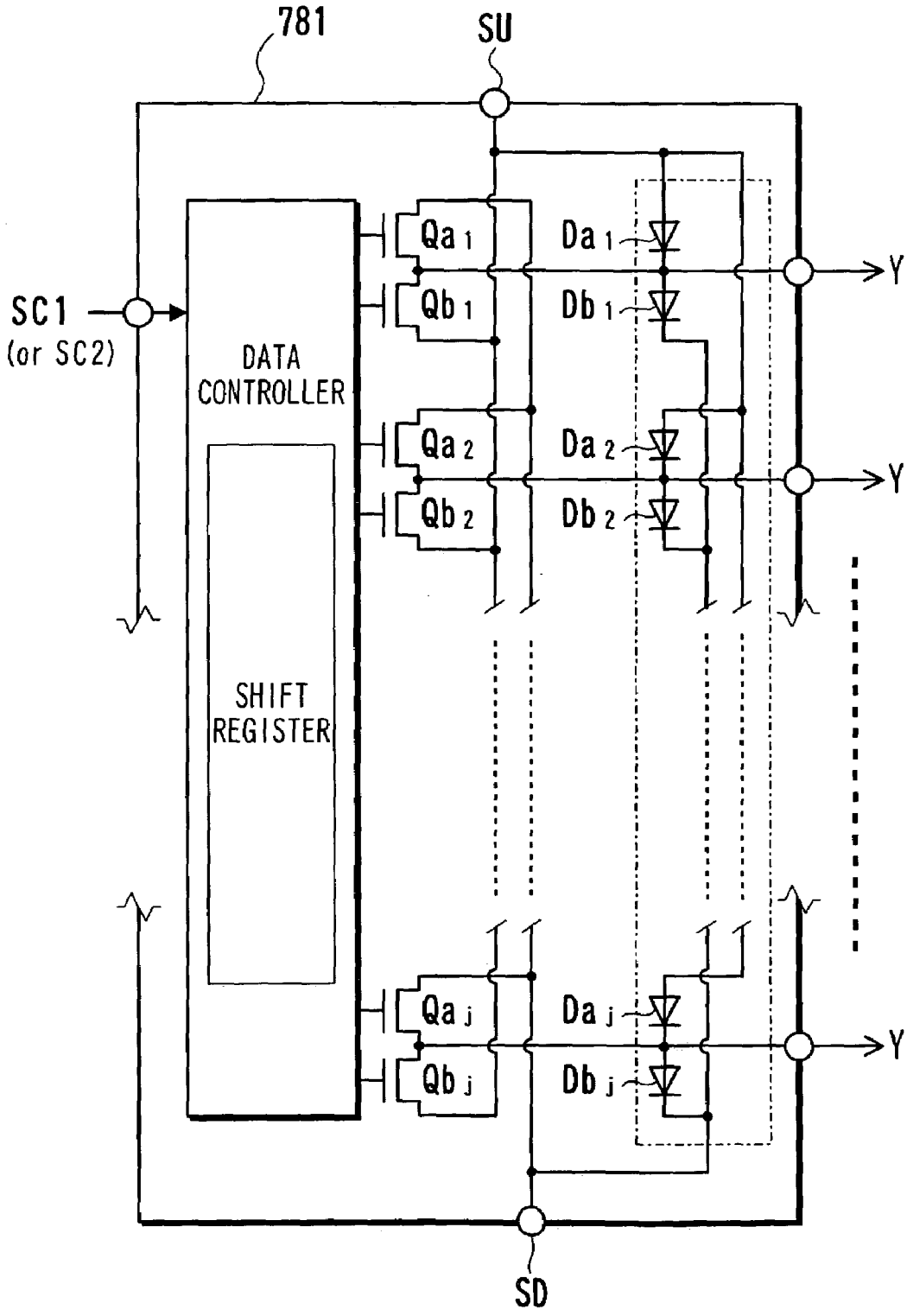
FIG. 9 shows a structure of a switch circuit that is called a scan driver.

FIG. 8 shows a detail structure of the Y-driver, and FIG. 9 shows a structure of a switch circuit that is called a scan driver. Here, among two blocks having the same structure, the structure of the A-block 78 will be explained as a type.

The A-block 78 includes a plurality of scan drivers 781 for controlling potential levels of n/2 display electrodes Y individually in a binary manner, two switches (more specifically, switching devices such as FETs) Q50 and Q60 for switching voltages that are applied to scan drivers, reset voltage circuits 782 and 783 for generating ramp waveform pulses, and a sustain circuit 790 for generating a sustain pulse. Each scan driver 781 is an integrated circuit device that is in charge of control of j display electrodes Y. In a typical scan driver 781 that is available, j is approximately 60–120. The sustain circuit 790 includes a switch for switching a potential level of the display electrode Y to either a sustaining potential Vs or a reference potential and a power recycling circuit that performs charge and discharge of capacitance between display electrodes at high speed utilizing LC resonance.

As shown in FIG. 9, each scan driver 781 has a pair of switches Qa and Qb for each of j display electrodes Y, j switches Qa are connected to a power source terminal SD commonly, and j switches Qb are connected to a power source terminal SU commonly. When the switch Qa is turned on, the display electrode Y is biased to the potential of the power source terminal SD at that time. When the switch Qb is turned on, the display electrode Y is biased to the potential of the power source terminal SU at that time. The control signal SC1 is given to the switches Qa and Qb via a shift register in a data controller, and a shift operation in synchronization with a clock realizes line selection in the arrangement order. The scan driver 781 includes diodes Da and Db that become current paths when the sustain pulse is applied.

Referring to FIG. 8, the power source terminals SU of all of the scan drivers 781 are connected to the power source (the potential Vya1) commonly via a diode D3 and the switch Q50. In addition, the power source terminals SD of all of the scan drivers 781 are connected to the power source (the potential Vya2) commonly via a diode D4 and the switch Q60. In the address period TA, when the switch Q50 is turned on responding to the control signal YA1D, the power source terminal SU is biased to the selecting potential Vya1. When the switch Q60 is turned on responding to the control signal YA2U, the power source terminal SD is biased to the non-selecting potential Vya2. In the sustain period TS (see FIG. 9), the switches Q50 and Q60 and the reset voltage circuits 782 and 783 are turned off, and all of the switches Qa and Qb in the scan driver are also turned off. Therefore, the potential levels of the power source terminals SU and SD depend on the operation of the sustain circuit 790.

Figure 10:
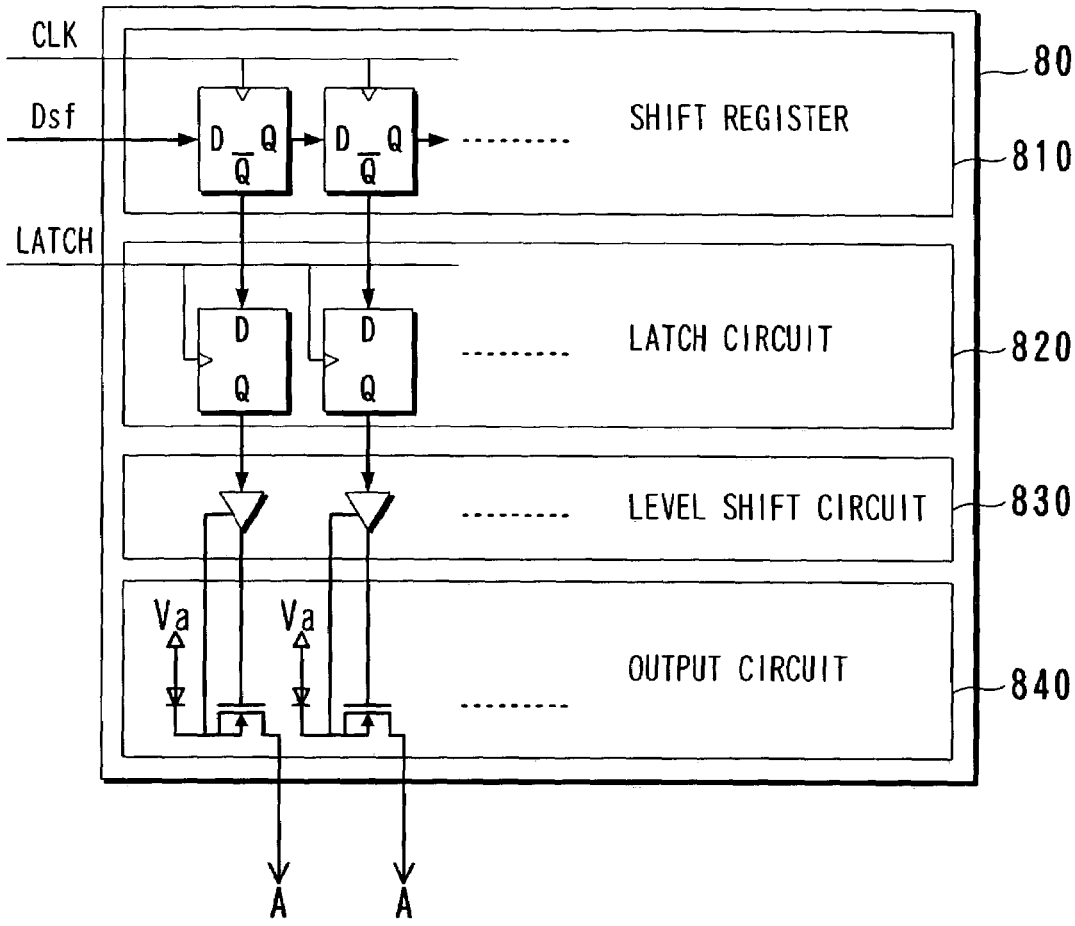
FIG. 10 shows a structure of an A-driver.

FIG. 10 shows a structure of an A-driver. The A-driver 80 is a general-purpose device without a function of overlapping data outputs for two rows. The A-driver 80 includes a shift register 810 for serial to parallel conversion, a latch circuit 820 for outputting subframe data Dsf of m columns at one time, a level shift circuit 830 for converting the latch output to a switch control signal, and an output circuit 840 for opening or closing a conductive path between the bias power source and the address electrode.

Figure 11:
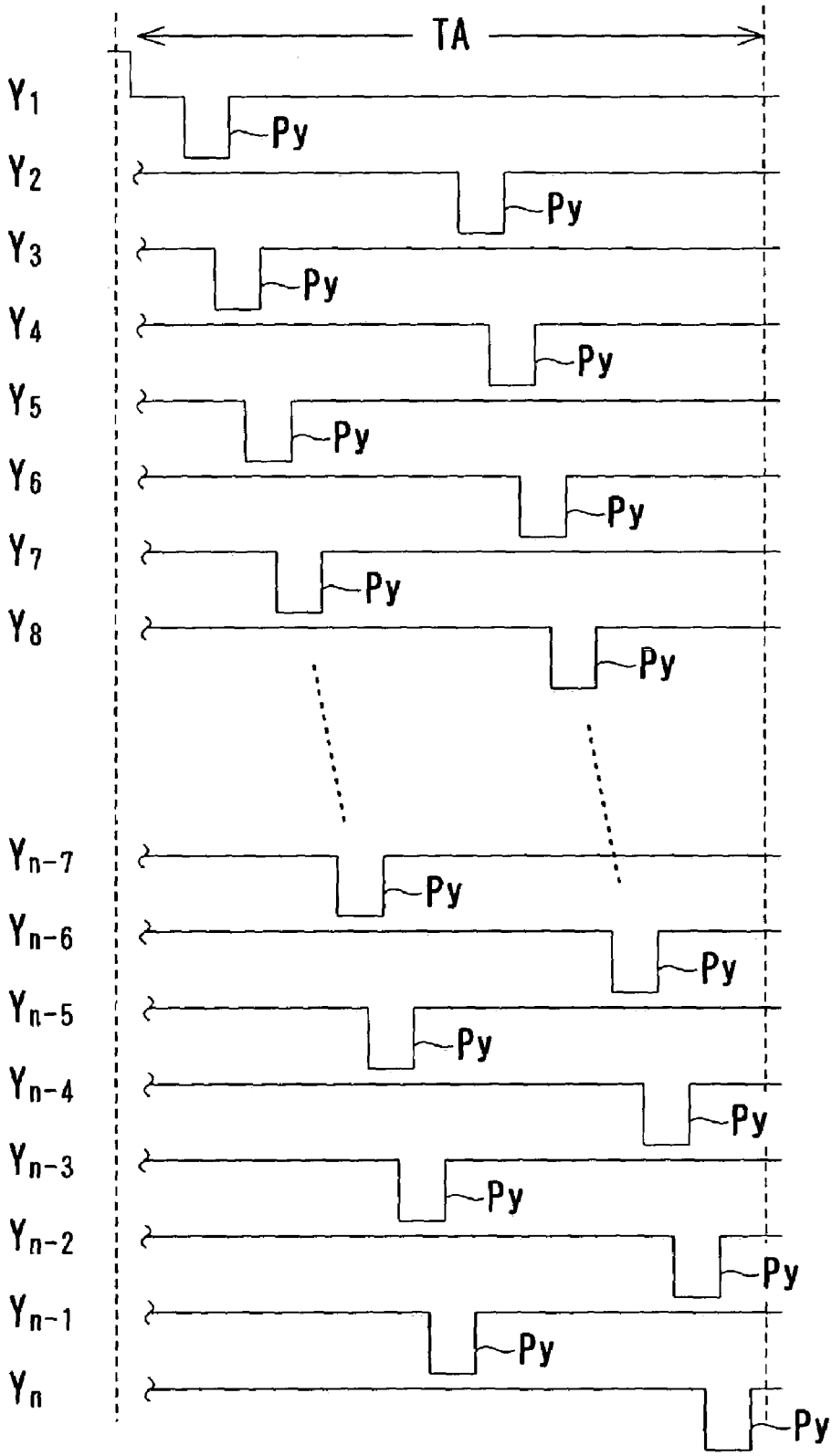
FIG. 11 shows another order of the row selection performed by the Y-driver.

FIG. 11 shows another order of the row selection performed by the Y-driver. In this example, the scan pulse Py is applied to odd display electrodes Y in the arrangement order, and after that the scan pulse Py is applied to even display electrodes Y in the arrangement order. In other words, the row selection order in this example is the arrangement order of every other row. Alternatively, scanning of the odd display electrodes Y can be performed after scanning even display electrodes Y. In order to realize the row selection in the order shown in FIG. 11, the A-block 78 of the Y-driver 77 may perform the scanning in the period having the same length as the period T2, and after that the B-block 79 may perform the scanning in the same way.

Figure 12:
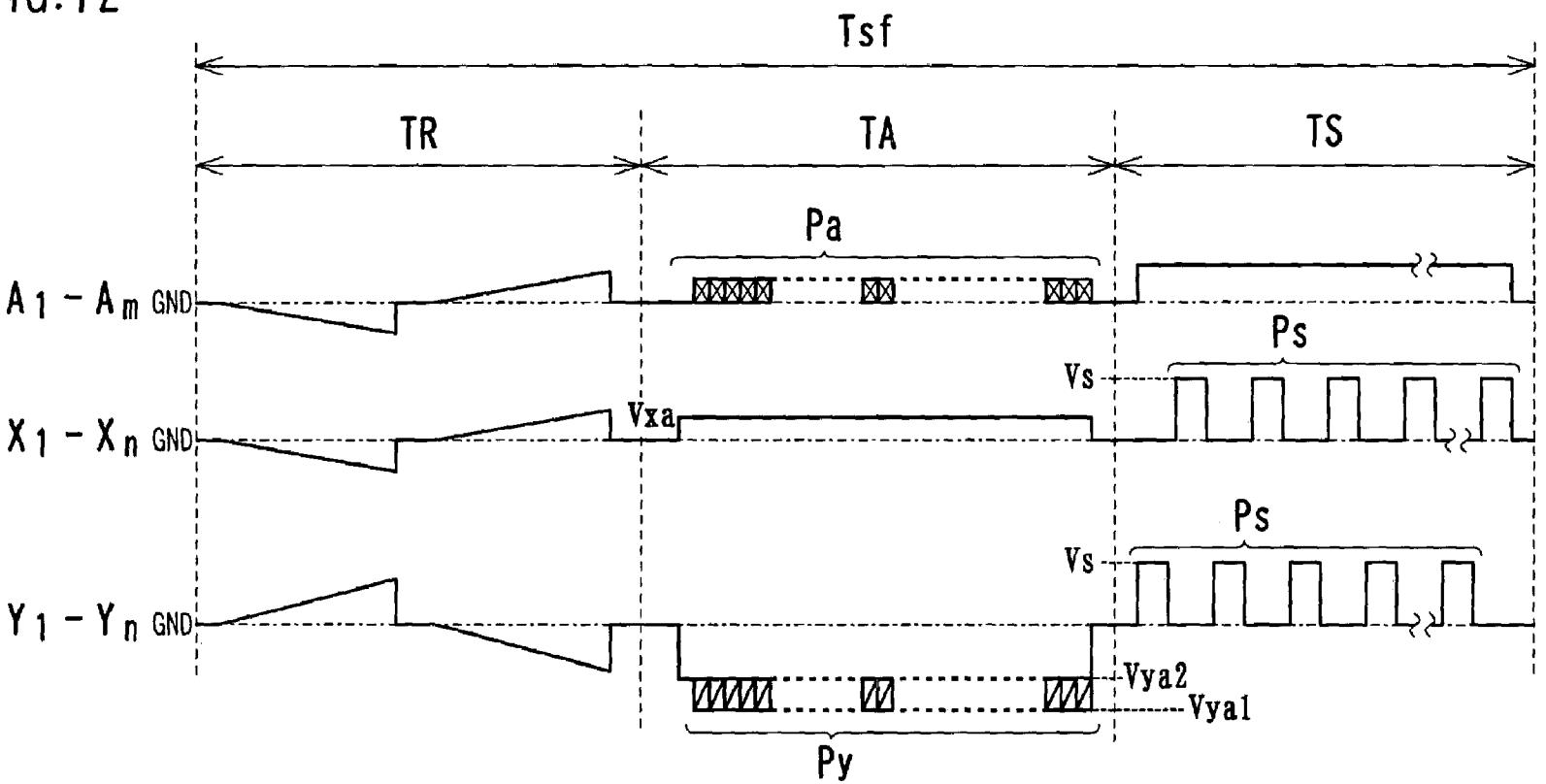
FIG. 12 shows a first variation of drive voltage waveforms.

Though the addressing in the above-mentioned embodiment has a writing form, it is possible to adopt an erasing form in which address discharge is generated in cells that are not to be lighted. An example of drive waveforms in that case is shown in FIG. 12. In the cell where address discharge is not generated, positive charge is remained adjacent to the display electrode X at the end of the address period TA. Therefore, the first sustain pulse Ps (having the positive polarity) is applied to the display electrode X in order to generate display discharge using the positive charge.

Figure 13:
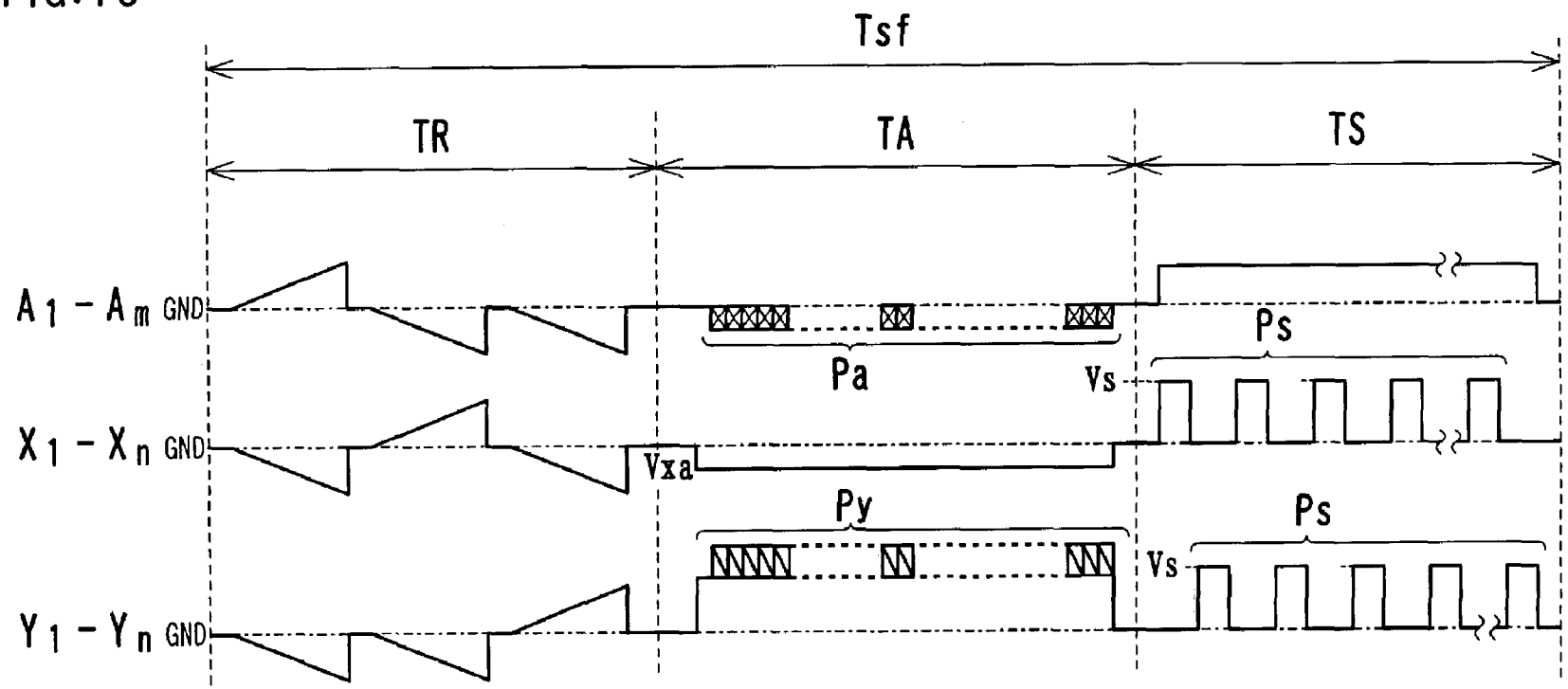
FIG. 13 shows a second variation of the drive voltage waveforms.
Figure 14A:
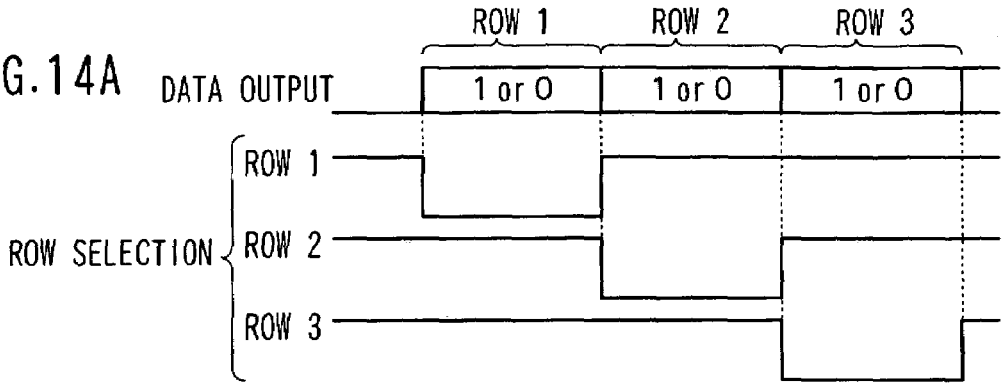
PRIOR ART FIG.14A
FIGS. 14A and 14B are timing charts of the row selection the data output in the conventional method.
Figure 14B:
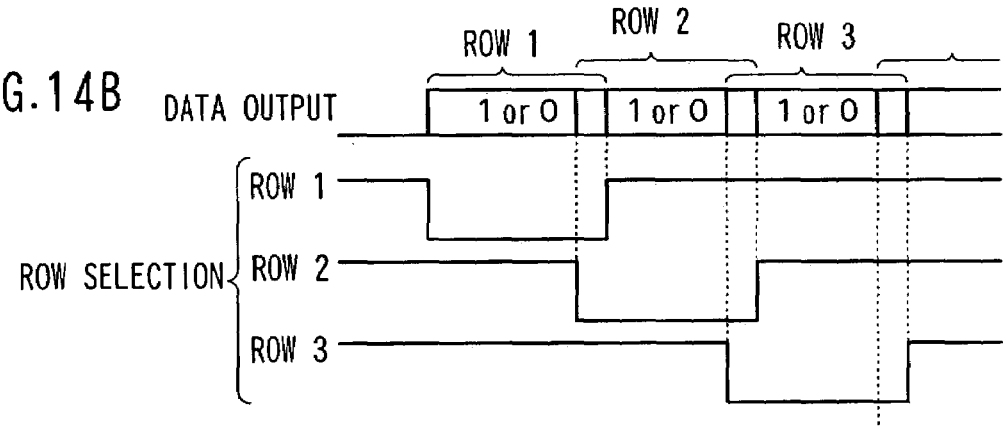

In addition, the present invention can be applied to a priming address drive in which light or non-light is controlled by intensity of address discharge without limited to a binary control of whether address discharge is generated or not. In addition, as shown in FIG. 13, the polarity of the drive waveform can be set so that the display electrode Y (the scan electrode) becomes an anode in the addressing process.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method for driving a plasma display panel having cells for a matrix display made of n rows and m columns, scan electrodes for selecting a row and data electrodes for selecting a column, the method comprising:

selecting a row by biasing a scan electrode corresponding to a selected row to a selecting potential for a constant period sequentially;

controlling potentials of the data electrodes in accordance with display data of the corresponding row in synchronization with the row selection of each row, starting j-th ($2 \leqq j \leqq n$) row selection prior to at least 230 nanoseconds to an end point during a (j-1)th row selection period; and changing the data electrodes potential from a control state corresponding to display data of the (j-1)th row to a control state corresponding to display data of the j-th row during a period in which the (j-1)th row selection and the j-th row selection period are overlapped with each other, wherein:

a display data period for a row is shorter than a selection period for the row, and the time, from the start time point of the period in which the (j-1)th row selection and the j-th row selection are overlapped with each other until the control state of the data electrodes potential is changed, is set to a value shorter than 150 nanoseconds.

2. A plasma display device comprising a plasma display panel and a driving circuit for driving the plasma display panel, wherein:

the plasma display panel comprises:

cells of a matrix display, of n rows and m columns, scan electrodes selecting a row, and data electrodes selecting a column; and the driving circuit selects a row by biasing a scan electrodo, to a selecting potential for a constant period sequentially, controls potentials of the data electrodes in accordance with display data of the corresponding row in synchronization with the row selection of each row, starts j-th ($2 \leqq j \leqq n$) row selection prior to at least 230 nanoseconds to an end at-a-point during a (j-1)th row selection period, and changes the data electrodes potential from a control state corresponding to display data of the (j-1)th row to a control state corresponding to display data of the j-th row during a period in which the (j-1)th row selection period and the j-th row selection period are overlapped with each other, wherein:

a display data output period for a row is shorter than a selection period for the row, and a timing of the changing said data electrodes potential for the (j-1) row is not later than 150 nanoseconds from a timing of said starting the j-th row selection.

3. The plasma display device according to claim 2, wherein the driving circuit includes an odd number block for driving scan electrodes whose arrangement order is an odd number among the scan electrodes, an even number block for driving scan electrodes whose arrangement order is an even number among the scan electrodes, and a controller for controlling the odd number and even number blocks so that the row selection of even rows is performed after the row selection of odd rows is performed.

4. The plasma display device according to claim 2, wherein the driving circuit includes an odd number block for driving scan electrodes whose arrangement order is an odd number among the scan electrodes, an even number block for driving scan electrodes whose arrangement order is an even number among the scan electrodes, and a controller for controlling the odd number and even number blocks so that the row selection of odd rows and the row selection of even rows are performed alternately, one row at a time.

5. A method for driving an AC type plasma display panel having scan electrodes and data electrodes orthogonal to the scan electrodes, the method comprising:

displaying one frame image using plural subframes, each of which includes an address period and a display period;

selecting a row by sequentially applying a scan pulse to the scan electrodes, in the address period, each of the scan pulses having a relation to overlap with one another for a duration equal to or more than 230 nanoseconds; and applying an address pulse corresponding to the selected row, to the data electrodes selectively and having a duration shorter than the scan pulses, wherein the address pulses for the j-th row are applied to the data electrodes in synchronization with the scan pulses without overlapping with the address pulses for the (j-1)th row within an initial 150 nanoseconds of a period when the scan pulses for the (j-1 )th row and the j-th row are overlapped with one another.

* * * * *

UNITED STATES PATENT AND TRADEMARK OFFICE

CERTIFICATE OF CORRECTION

PATENT NO. : 7,123,218 B2
APPLICATION NO. : 10/459608
DATED : October 17, 2006
INVENTOR(S) : Kunio Takayama et al.

It is certified that error appears in the above-identified patent and that said Letters Patent is hereby corrected as shown below:

Col. 8, line 57, change "row"' to --row;--

Col. 9, lines 15-16, change "electrodo" to --electrode--

Col. 9, line 21, change "at-a-point" to --point--

Col. 10, line 33, change "(j-1 )th" to --(j-1)th--

Signed and Sealed this

Sixth Day of March, 2007

JON W. DUDAS
*Director of the United States Patent and Trademark Office*